US011105123B1

(12) United States Patent
Ruffkess et al.

(10) Patent No.: US 11,105,123 B1
(45) Date of Patent: Aug. 31, 2021

(54) LOCK APPARATUSES AND METHODS

(71) Applicant: BoxLock, Inc., Atlanta, GA (US)

(72) Inventors: Brad A. Ruffkess, Atlanta, GA (US); Hugo Giralt Echevarria, Oakland, CA (US); Siddharth Vanchinathan, Oakland, CA (US); Alejandro Castillejo Munoz, San Francisco, CA (US); Taylor Davis, Atlanta, GA (US); Brian VanHiel, Smyrna, GA (US)

(73) Assignee: BOXLOCK, INC., Atlanta, GA (US)

( * ) Notice: Subject to any disclaimer, the term of this patent is extended or adjusted under 35 U.S.C. 154(b) by 139 days.

(21) Appl. No.: 16/220,527

(22) Filed: Dec. 14, 2018

Related U.S. Application Data

(60) Provisional application No. 62/598,573, filed on Dec. 14, 2017.

(51) Int. Cl.
*E05B 67/22* (2006.01)
*G07C 9/00* (2020.01)

(52) U.S. Cl.
CPC ..... *E05B 67/22* (2013.01); *G07C 9/00182* (2013.01); *G07C 2009/0019* (2013.01)

(58) Field of Classification Search
CPC ..... E05B 67/22; E05B 67/24; E05B 67/18; E05B 67/063; G07C 2009/0019; G07C 9/00182
USPC ..... 70/25, 26, 38 A, 38 B, 38 C, 38 R, 39, 70/386
See application file for complete search history.

(56) References Cited

U.S. PATENT DOCUMENTS 5,189,893 A * 3/1993 Kortenbrede ..... E05B 67/24 70/379 R
5,624,071 A * 4/1997 Sosan ..... A47G 29/20 232/1 B
6,047,573 A * 4/2000 Martinez ..... E05B 67/383 220/367.1
6,047,575 A * 4/2000 Larson ..... E05B 47/0012 250/231.14
6,384,711 B1 5/2002 Cregger
6,442,983 B1 * 9/2002 Thomas ..... E05B 47/0012 70/278.1
6,584,815 B2 * 7/2003 Bremicker ..... E05B 67/04 70/38 A (Continued)

FOREIGN PATENT DOCUMENTS

WO 2017210797 A1 12/2017

OTHER PUBLICATIONS

Non-final Office Action issued in pending U.S. Appl. No. 15/586,512 dated Mar. 16, 2021.

(Continued)

*Primary Examiner* — Lloyd A Gall
(74) *Attorney, Agent, or Firm* — Morris, Manning & Martin, LLP; Daniel E. Sineway, Esq.; Adam J. Thompson, Esq.

(57) ABSTRACT

Moto-controlled lock apparatus/mechanism that deploys locking pins to retain the shackle when the lock apparatus/mechanism is in the closed position. Generally, when the lock apparatus/mechanism is in the closed position, the locking pins are prevented from moving by a blocking cam. In various embodiments, the blocking cam is actuated by a motor that rotates the blocking cam, thereby forcing the locking pins into and holding the locking pins in compatibly-shaped cutouts in the shackle.

22 Claims, 5 Drawing Sheets

(56) References Cited

U.S. PATENT DOCUMENTS

| | | | | |
|---|---|---|---|---|
| 6,761,051 | B1 * | 7/2004 | Tsai | E05B 47/0012 70/257 |
| 7,552,607 | B2 * | 6/2009 | Yang | E05B 35/105 70/21 |
| 7,562,545 | B2 * | 7/2009 | Lai | E05B 35/105 70/21 |
| 7,934,405 | B2 * | 5/2011 | Burmesch | E05B 37/10 70/25 |
| 8,225,629 | B2 * | 7/2012 | Zuraski | E05B 67/003 70/21 |
| 8,453,481 | B2 * | 6/2013 | Meekma | E05B 47/0012 70/38 A |
| 8,806,907 | B2 * | 8/2014 | Kalous | E05B 67/06 70/278.1 |
| 8,850,858 | B2 * | 10/2014 | Nave | E05B 47/06 70/279.1 |
| 9,646,165 | B1 | 5/2017 | Saylor | |
| 2002/0103653 | A1 | 8/2002 | Huxter | |
| 2006/0283216 | A1 * | 12/2006 | Marcelle | G07C 9/00182 70/38 A |
| 2007/0126551 | A1 | 6/2007 | Slevin | |
| 2010/0283575 | A1 | 11/2010 | Tubb et al. | |
| 2013/0036781 | A1 | 2/2013 | Hartmann | |
| 2013/0086956 | A1 * | 4/2013 | Nave | E05B 67/22 70/20 |
| 2014/0100687 | A1 | 4/2014 | Ekstrom | |
| 2015/0120529 | A1 | 4/2015 | Faaborg | |
| 2015/0225986 | A1 * | 8/2015 | Goldman | E05B 67/02 70/20 |
| 2015/0292244 | A1 | 10/2015 | Beatty | |
| 2015/0310381 | A1 | 10/2015 | Lyman et al. | |
| 2016/0217637 | A1 | 7/2016 | Gengler | |
| 2016/0331171 | A1 | 11/2016 | Jiang | |
| 2017/0009491 | A1 | 1/2017 | Nguyen et al. | |
| 2018/0060812 | A1 | 3/2018 | Robinson | |

OTHER PUBLICATIONS

Final Office Action issued in pending U.S. Appl. No. 15/586,512, dated Sep. 2, 2020.

Non-final Office Action issued in pending U.S. Appl. No. 15/586,512 dated Mar. 5, 2020.

International Search Report and Written Opinion issued in International Application No. PCT/US2019/019374, dated May 1, 2019.

* cited by examiner

LOCK APPARATUSES AND METHODS

CROSS REFERENCE TO RELATED APPLICATIONS

This application claims priority to, the benefit under 35 U.S.C. § 119 of, and incorporates by reference herein in its entirety U.S. Provisional Patent Application No. 62,598,573, filed Dec. 14, 2017, and entitled "Lock Apparatuses and Methods."

TECHNICAL FIELD

The present disclosure relates generally to lock apparatuses and, more particularly, to lock apparatuses secured by rotating cams.

BACKGROUND

Locks comprising shackles, such as padlocks, are generally not secure and are subject to known methods of manipulation to maliciously open/access them. Further, locks comprising shackles are not easily integrated with wireless technologies to permit remote access/monitoring of the same.

Therefore, there is a long-felt but unresolved need for a lock apparatus as shown and described herein.

BRIEF SUMMARY OF THE DISCLOSURE

Briefly described, and according to one embodiment, aspects of the present disclosure generally relate to a lock apparatus/mechanism that deploys locking pins to retain the shackle when the lock apparatus/mechanism is in the closed position. Generally, when the lock apparatus/mechanism is in the closed position, the locking pins are prevented from moving by a blocking cam. In various embodiments, the blocking cam is actuated by a motor that rotates the blocking cam, thereby forcing the locking pins into and holding the locking pins in compatibly-shaped cutouts in the shackle. This rotating blocking cam more securely, efficiently, and effectively locks the lock apparatus.

In one embodiment, a lock apparatus, comprising: at least one cylindrical locking pin; a shackle comprising at least one cutout that is compatibly-shaped to accept at least a portion of the at least one cylindrical locking pin; a blocking cam comprising at least one sloped surface and at least one perpendicular surface; and an actuating mechanism that rotates the blocking cam so that the at least one perpendicular surface secures the at least one cylindrical locking pin within the at least one cutout.

In one embodiment, a method of securing a package with a lock apparatus, comprising the steps of: inserting a package into a container comprising a closure consisting of a hasp and a loop; closing the hasp over the loop; inserting, through the loop, a shackle of the lock apparatus through the loop, wherein the shackle comprises at least one cutout that is compatibly-shaped to accept at least a portion of at least one cylindrical locking pin and wherein the lock apparatus further comprises: a lock body; the at least one cylindrical locking pin; a blocking cam comprising at least one sloped surface and at least one perpendicular surface; and an actuating mechanism that rotates the blocking cam so that the at least one perpendicular surface secures the at least one cylindrical locking pin within the at least one cutout; inserting the shackle into the lock body; and actuating the actuating mechanism to secure the at least one cylindrical locking pin within the at feast one cutout.

According to one aspect of the present disclosure, the lock apparatus, wherein the at least one cylindrical locking pin comprises a first cylindrical locking pin and a second cylindrical locking pin. Furthermore, the lock apparatus, wherein the at least one cutout comprises a first cutout and a second cutout, wherein the first cutout is compatibly-shaped to accept at least a portion of the first cylindrical locking pin and the second cutout is compatibly-shaped to accept at least a portion of the second cylindrical locking pin. Moreover, the lock apparatus, wherein the at least one perpendicular surface comprises a first perpendicular surface and a second perpendicular surface, wherein the first perpendicular surface secures the first cylindrical locking pin with the first cutout and the second perpendicular surface secures the second cylindrical locking pin with the second cutout. Further, the lock apparatus, wherein the actuating mechanism comprises a motor.

According to one aspect of the present disclosure, the lock apparatus, wherein the motor is engaged by a plunger, a wireless signal, a button, or a key. Additionally, the lock apparatus, wherein the blocking cam further comprises a motor interface, a stop feature, and a shaft. Also, the lock apparatus, further comprising a lock body, wherein the lock body defines at least one void in which the at least one cylindrical locking pin rests. In addition, the lock apparatus, wherein the lock body further defines a void in which the blocking cam rotates, wherein the void and the at least one void are connected. Moreover, the lock apparatus, further comprising: a shackle retaining pin; a retaining sleeve; a motor; a lock body; a plunger; and two springs.

According to one aspect of the present disclosure, the method, wherein the at least one cylindrical locking pin comprises a first cylindrical locking pin and a second cylindrical locking pin. Furthermore, the method, wherein the at least one cutout comprises a first cutout and a second cutout, wherein the first cutout is compatibly-shaped to accept at least a portion of the first cylindrical locking pin and the second cutout is compatibly-shaped to accept at least a portion of the second cylindrical locking pin. Moreover, the method, wherein the at least one perpendicular surface comprises a first perpendicular surface and a second perpendicular surface, wherein the first perpendicular surface secures the first cylindrical locking pin with the first cutout and the second perpendicular surface secures the second cylindrical locking pin with the second cutout. Further, the method, wherein the actuating mechanism comprises a motor.

According to one aspect of the present disclosure, the method, wherein the motor is engaged by a plunger, a wireless signal, a button, or a key, wherein the step of actuating the actuating mechanism further comprises pressing the plunger, sending the wireless signal, pressing the button, or turning the key. Additionally, the method, wherein the blocking cam further comprises a motor interface, a stop feature, and a shaft. Also, the method, wherein the lock body defines at least one void in which the at least one cylindrical locking pin rests. In addition, the method, wherein the lock body further defines a void in which the blocking cam rotates, wherein the void and the at least one void are connected. Furthermore, the method, wherein the lock apparatus further comprises: a shackle retaining pin; a retaining sleeve; a motor; a lock body; a plunger; and two springs.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
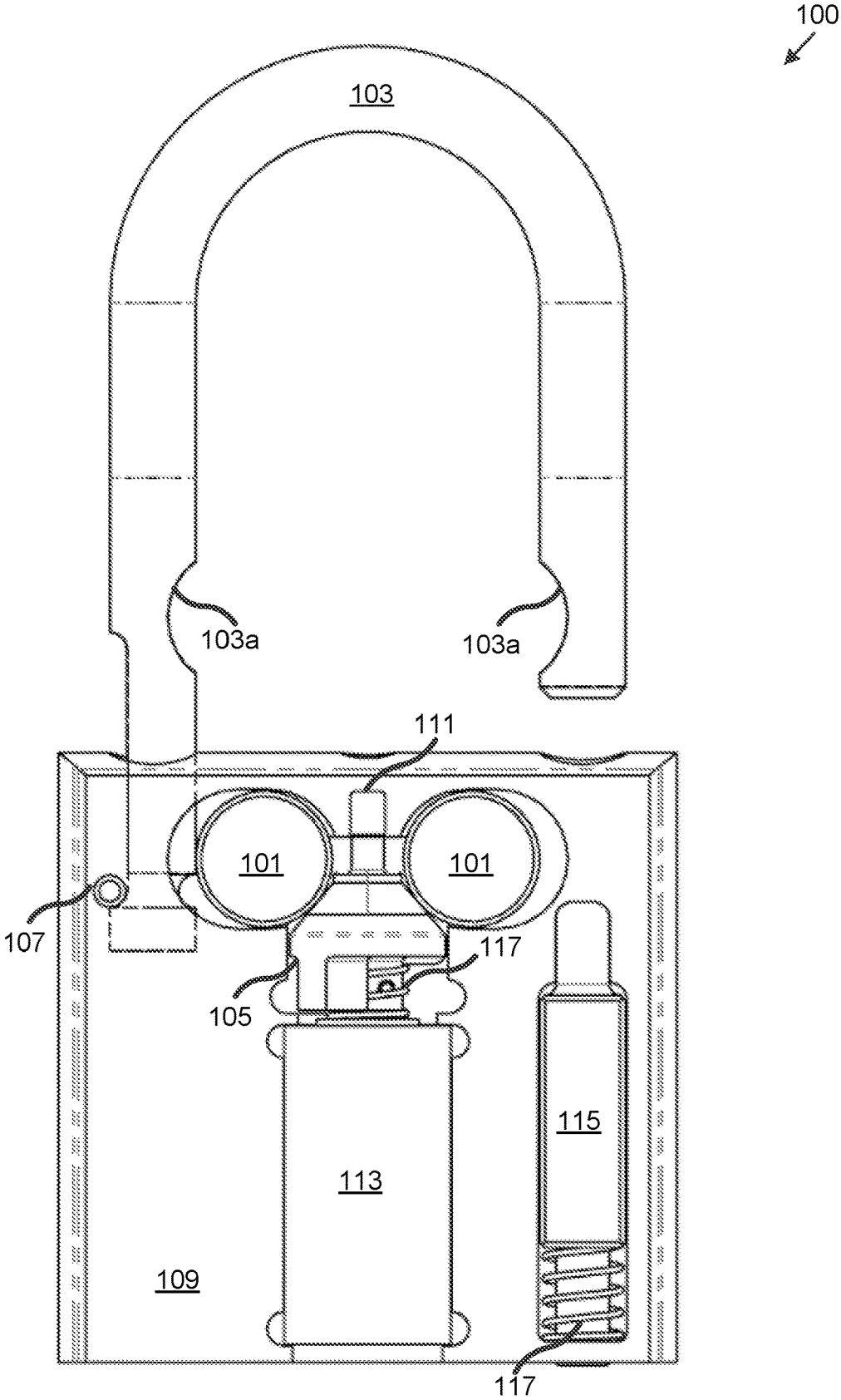
FIG. 1 illustrates an exemplary open lock with open shackle, according to one embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Overview

Aspects of the present disclosure generally relate to a lock apparatus/mechanism that deploys locking pins to retain the shackle when the lock apparatus/mechanism is in the closed position. Generally, when the lock apparatus/mechanism is in the closed position, the locking pins are prevented from moving by a blocking cam. In various embodiments, the blocking cam is actuated by a motor that rotates the blocking cam, thereby forcing the locking pins into and holding the locking pins in compatibly-shaped cutouts in the shackle. This rotating blocking cam more securely, efficiently, and effectively locks the lock apparatus.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

Exemplary Embodiments

Referring now to the figures, for the purposes of example and explanation of the fundamental processes and components of the disclosed apparatuses and methods, reference is made to FIGS. 1-5, which illustrates details regarding an exemplary lock 100 according to one embodiment of the present disclosure. As will be understood and appreciated, FIGS. 1-5 represent merely one approach or embodiment of the present apparatuses and methods, and other aspects are used according to various embodiments of the present disclosure.

In various embodiments, the lock 100 generally comprises two locking pins 101, a shackle 103, and a blocking cam 105, as well as a shackle retaining pin 107 (generally prevents the shackle 103 from separating from lock body 109), retaining sleeve 111 (generally holds the blocking cam 105 in place), motor 113, plunger 115 (generally actuates the motor 113 when the shackle 103 is inserted into the lock body 109), lock body 109, various springs 117, and various electronics (e.g., printed circuit board, wires, batteries, etc.) to operate the motor 113 or other components. Generally, this disclosure places no limitations on the materials or shapes of these various disclosed components, so long as the materials (e.g., steel, brass, iron, plastic, etc.) and shapes permit the components to operate as described and/or intended. The lock 100 may comprises seals, gaskets, or other components to prevent water from entering the lock 100.

In one embodiment, the lock 100 generally comprises only one locking pin 101. In one embodiment, the lock 100 generally comprises three locking pins 101. In one embodiment, the lock 100 generally comprises four locking pins 101. In various embodiments, one or more locking pins 101 retain the shackle 103 within a lock body 109 to prevent the lock 100 from opening. Generally, the pins 101 are prevented from moving (thereby preventing the shackle 103 from opening) by a blocking cam 105 that is turned by a motor 113 or other mechanism but able to slide along its axis (e.g., mechanical gears configured to be actuated by a key, etc.). In various embodiments, the motor 113 may be actuated by physical turning of a key, receiving a signal (e.g., Bluetooth, WiFi, cellular data, near-field communication, etc.), pressing a button, plunger 115/spring 117, etc. In various embodiments, the locking pins 101 are cylindrical and made of steel or other hardened metal/material. Generally, the locking pins 101, when engaged or disengaged by the blocking cam 105, roll within one or more voids in the lock body 109 to secure or release the shackle 103.

In the open position (as shown in FIG. 1), the blocking cam 105 is generally turned so that the shackle 103 may push the locking pins 101 medial (e.g., perpendicular to the vertical arms of the shackle). In one embodiment, the locking pins 101, in the open position, drive the blocking cam 105 downward against a spring 117 after the shackle 103 pushes the pins 101 medial.

Figure 2:
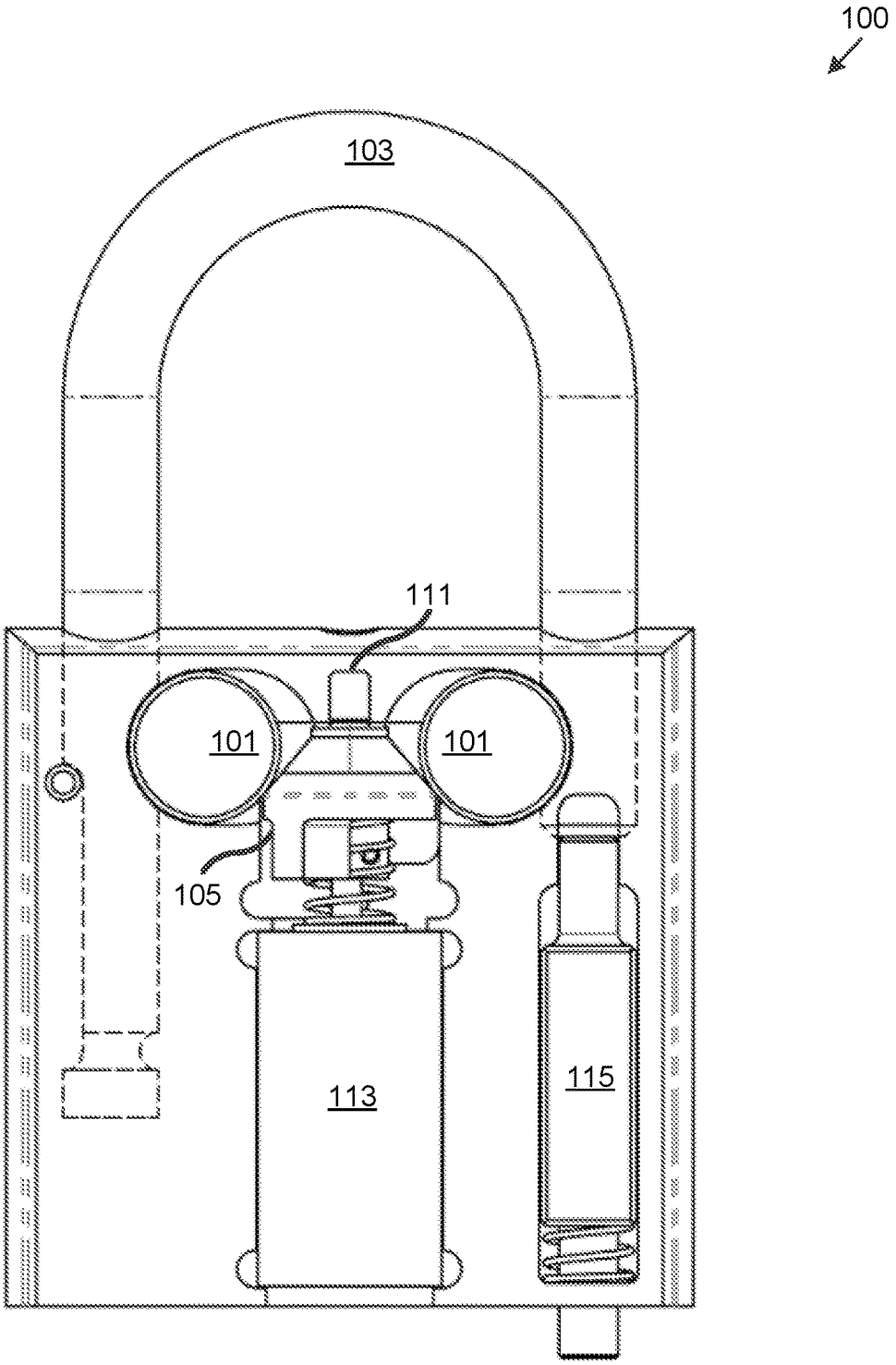
FIG. 2 illustrates an exemplary open lock with closed shackle, according to one embodiment of the present disclosure.

In the closed (but unlocked) position (as shown in FIG. 2), the locking pins 101 generally rest in cutouts 103*a* in the shackle 103 that are shaped to accept the locking pins 101. In one embodiment (as shown), the cutouts 103*a* are semi-circular cutouts to accept cylindrical locking pins 101. In an alternate embodiment (not shown), the cutouts are rectangular to accept square pins 101, etc. Generally, the shackle 103 comprises as many cutouts 103*a* as the lock 100 comprises locking pins 101. The blocking cam 105 is generally driven upward by a spring, and its sloped surface drives the pins 101 into the cutouts. The short end of the shackle 103, in one embodiment, presses on the plunger 115 (which in turns contacts a switch on a printed circuit board), indicating to the controller that the lock 100 is closed and that the motor 113 may be used to turn the blocking cam 105. In one embodiment (not shown in the figures), the plunger is on the opposite side of the lock body 109 (e.g., generally underneath the shackle retaining pin 107) such that it is pressed by the long end of the shackle 103. In one embodiment, without rotating the blocking cam 105, the shackle 103 may still be opened.

Figure 3:
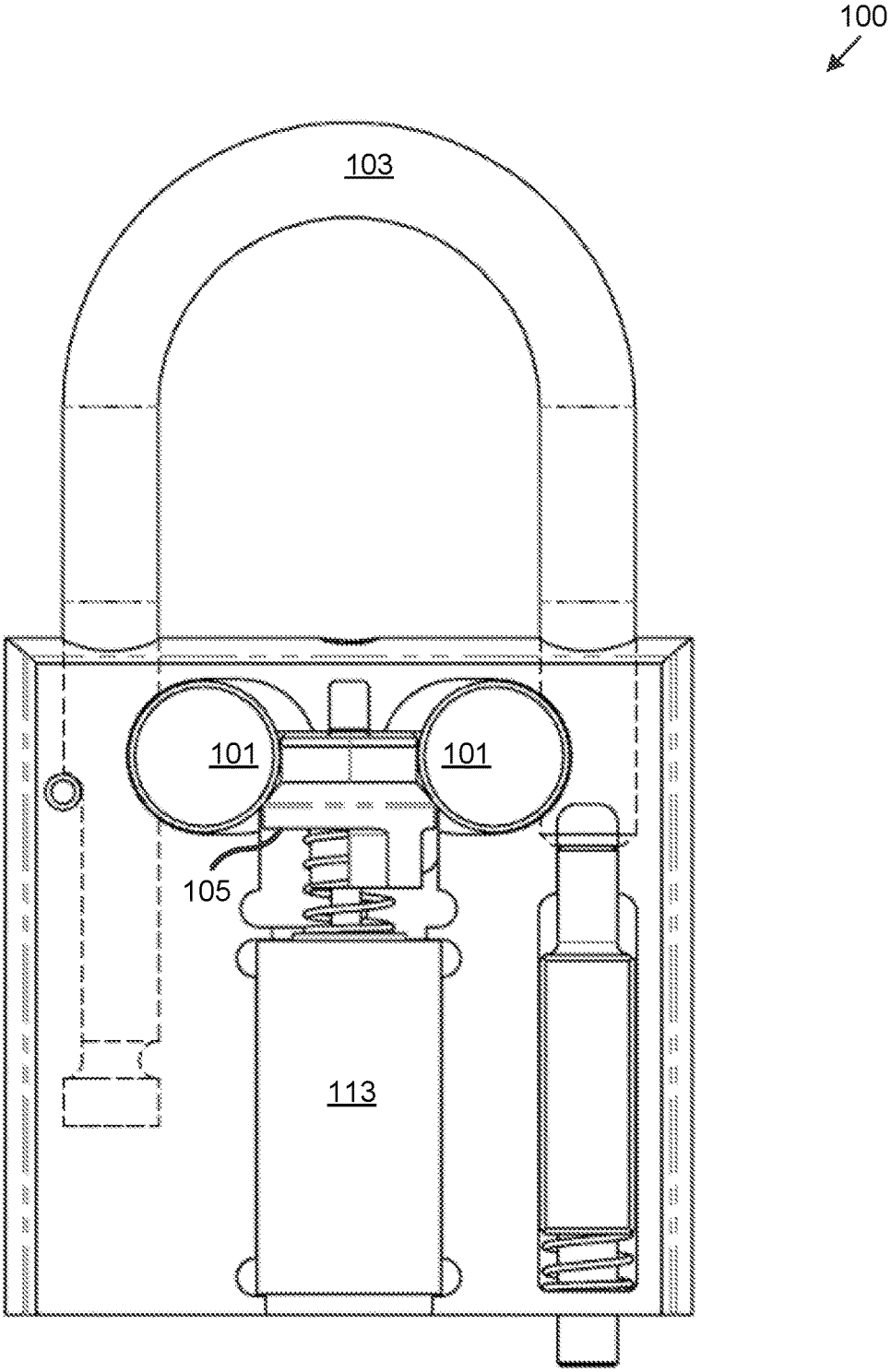
FIG. 3 illustrates an exemplary closed lock, according to one embodiment of the present disclosure.
Figure 4:
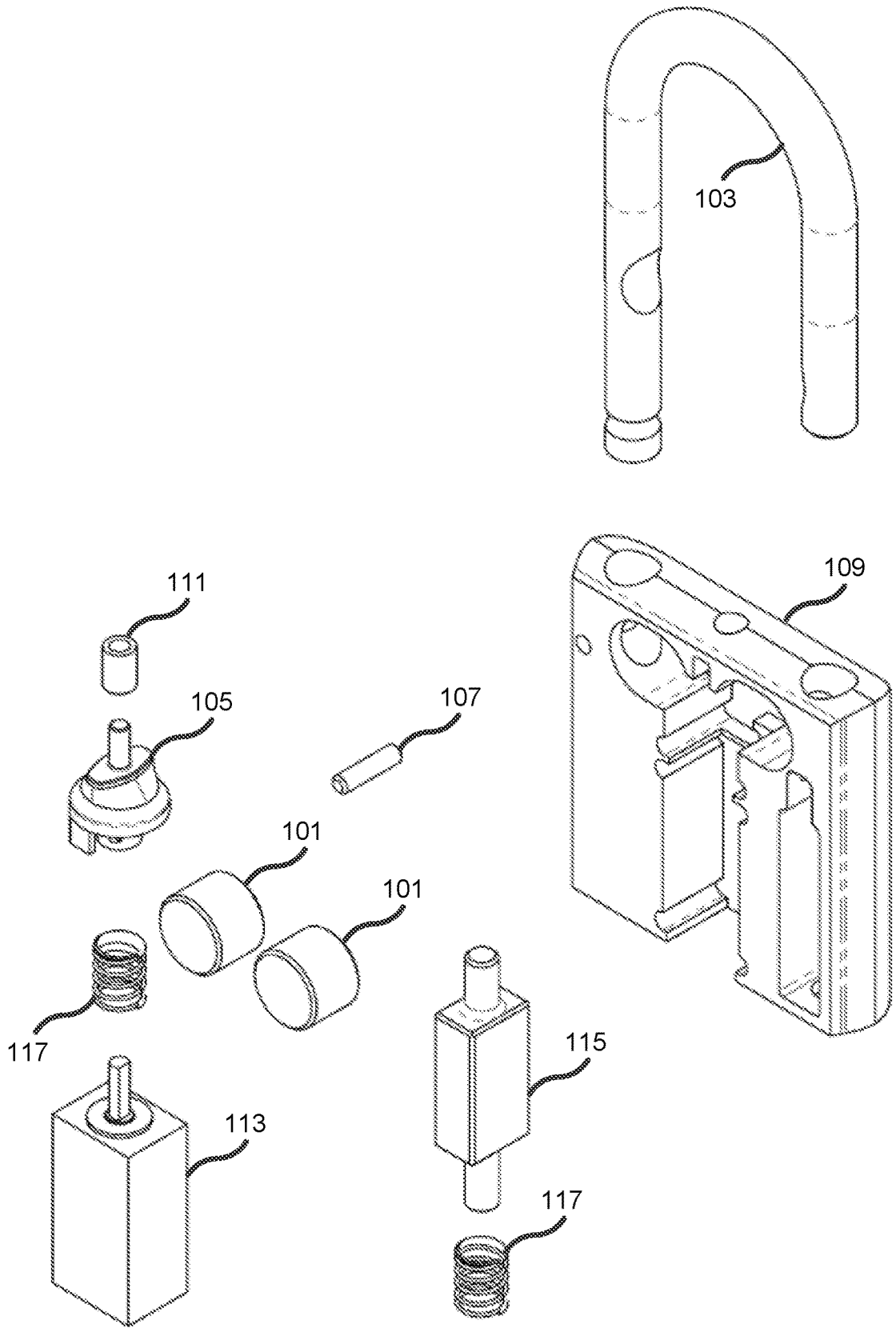
FIG. 4 illustrates an exploded view of an exemplary lock, according to one embodiment of the present disclosure.

In the locked position (as shown in FIG. 3), in various embodiments, the cam 105 is rotated by the motor 113 approximately 90 degrees to present its non-sloped surfaces 507 to the locking pins 101. Thus, in one embodiment, the locking pins 101 are blocked from being driven medial by the blocking cam 105 when pressure is applied to the same, preventing the shackle 103 from moving/opening. In one embodiment, the blocking cam 105 does not comprise sloped surfaces (not shown in FIG. 5); instead, the blocking cam 105 comprises a narrow and wide portion, such that when the blocking cam 105 rotates the wide portion drives the locking pins 101 medial, thereby preventing the shackle 103 from moving/opening.

Figure 5C:
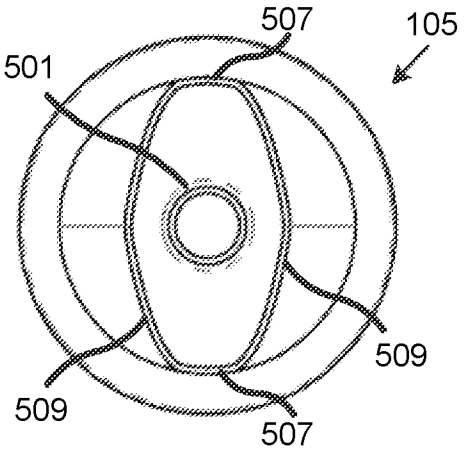
FIG. 5 (consisting of FIGS. 5A-5E) illustrates perspective, bottom, top, front side, and right side views, respectively, of an exemplary blocking cam, according to one embodiment of the present disclosure.
Figure 5B:
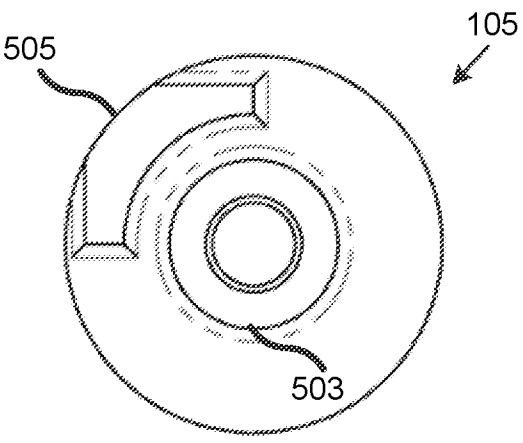
Figure 5A:
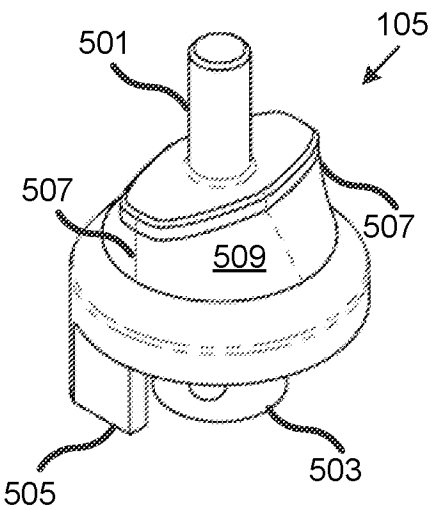
Figure 5E:
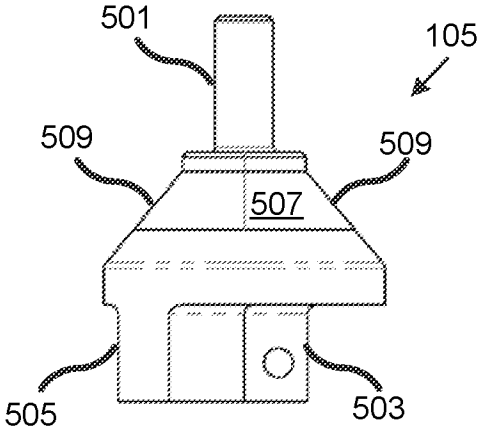
Figure 5D:
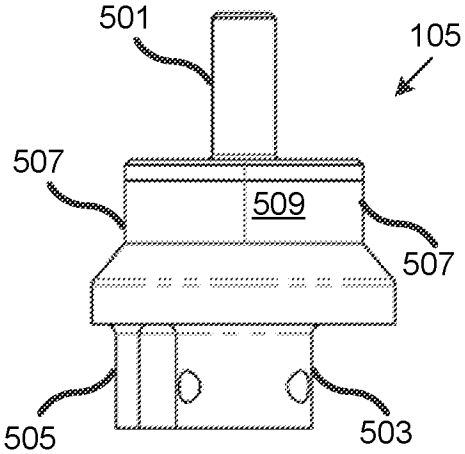

FIG. 5 illustrates perspective (FIG. 5A), bottom (FIG. 5B), top (FIG. 5C), front side (FIG. 5D), and right side (FIG. 5E views of an exemplary blocking cam 105, according to one embodiment of the present disclosure. Generally, the block cam 105 comprises a shaft 501, motor interface 503, stop feature 505, and a shaped feature comprising non-sloped/perpendicular surfaces 507 and sloped surfaces 509. In various embodiments, the shaft 501 fits within the retaining sleeve 111 to permit the blocking cam 105 to move along its axis. The motor interface 503, in one embodiment, permits the blocking cam 105 to connect to the motor 113 to actuate the blocking cam 105. The stop feature 505, in various embodiments, prevents the blocking cam 105 from rotating too far when actuated (e.g., past the point where it holds the locking pins 101 in place. The shaped feature is shaped such that, when the blocking cam 105 is actuated/rotated to secure the lock 100, the non-sloped surfaces 507 hold the locking pins 101 in place (whereas the sloped surfaces 509 permit the locking pins to release from the shackle 103).

In one embodiment, the blocking cam 105 is substantially conical frustum-shaped, with an obround protrusion that comprises sloped surfaces 509 along the parallel sides of the obround protrusion and non-sloped surfaces 507 along the semicircular ends of the obround. Extending from the top of the obround protrusion, in one embodiment, is a cylindrical shaft 501; extending in the opposite direction from the shaft 501 is the motor interface 503. Although the particular configuration of the motor interface 503 is dependent upon the motor 113 with which it interfaces, in one embodiment, the motor interface 503 is substantially cylindrical with one or more holes or voids that permit it to attach to the motor 113. Generally, the stop feature 505 is of the same height as the motor interface 503.

Generally, this disclosure places no limitations on the use cases for the disclosed lock apparatus 100. For example, the lock apparatus 100 may be used to secure packages, lock boxes, storage sheds, warehouses, fences, or any other location/item that is capable of being secured by a lock 100 with a shackle 103.

As will be understood by one having ordinary skill in the art, the steps and processes described herein may operate concurrently and continuously, are generally asynchronous and independent, and are not necessarily performed in the order described.

While various aspects have been described in the context of a preferred embodiment, additional aspects, features, and methodologies of the claimed inventions will be readily discernible from the description herein, by those of ordinary skill in the art. Many embodiments and adaptations of the disclosure and claimed inventions other than those herein described, as well as many variations, modifications, and equivalent arrangements and methodologies, will be apparent from or reasonably suggested by the disclosure and the foregoing description thereof, without departing from the substance or scope of the claims. Furthermore, any sequence(s) and/or temporal order of steps of various processes described and claimed herein are those considered to be the best mode contemplated for carrying out the claimed inventions. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the claimed inventions. In addition, some steps may be carried out simultaneously, contemporaneously, or in synchronization with other steps.

The embodiments were chosen and described in order to explain the principles of the claimed inventions and their practical application so as to enable others skilled in the art to utilize the inventions and various embodiments and with various modifications as are suited to the particular use contemplated. Alternative embodiments will become apparent to those skilled in the art to which the claimed inventions pertain without departing from their spirit and scope. Accordingly, the scope of the claimed inventions is defined by the appended claims rather than the foregoing description and the exemplary embodiments described therein.

What is claimed is:

1. A lock apparatus, comprising:

at least one cylindrical locking pin, wherein the at least one cylindrical locking pin comprises a first cylindrical locking pin and a second cylindrical locking pin;

a shackle comprising at least one cutout that is compatibly-shaped to accept at least a portion of the at least one cylindrical locking pin;

a blocking cam comprising at least one sloped surface and at least one perpendicular surface; and an actuating mechanism that rotates the blocking cam so that the at least one perpendicular surface secures the at least one cylindrical locking pin within the at least one cutout.

2. The lock apparatus of claim 1, wherein the at least one cutout comprises a first cutout and a second cutout, wherein the first cutout is compatibly-shaped to accept at least a portion of the first cylindrical locking pin and the second cutout is compatibly-shaped to accept at least a portion of the second cylindrical locking pin.

3. The lock apparatus of claim 2, wherein the at least one perpendicular surface comprises a first perpendicular surface and a second perpendicular surface, wherein the first perpendicular surface secures the first cylindrical locking pin with the first cutout and the second perpendicular surface secures the second cylindrical locking pin with the second cutout.

4. The lock apparatus of claim 1, wherein the actuating mechanism comprises a motor.

5. The lock apparatus of claim 1, further comprising a lock body, wherein the lock body defines at least one void in which the at least one cylindrical locking pin rests.

6. The lock apparatus of claim 5, wherein the lock body further defines a void in which the blocking cam rotates, wherein the void and the at least one void are connected.

7. The lock apparatus of claim 1, further comprising: a shackle retaining pin; a retaining sleeve; a motor; a lock body; a plunger; and two springs.

8. A method of securing a package with a lock apparatus, comprising the steps of:

inserting a package into a container comprising a closure consisting of a hasp and a loop;

closing the hasp over the loop;

inserting, through the loop, a shackle of the lock apparatus through the loop, wherein the shackle comprises at least one cutout that is compatibly-shaped to accept at least a portion of at least one cylindrical locking pin and wherein the lock apparatus further comprises:

a lock body;

the at least one cylindrical locking pin, wherein the at least one cylindrical locking pin comprises a first cylindrical locking pin and a second cylindrical locking pin;

a blocking cam comprising at least one sloped surface and at least one perpendicular surface; and an actuating mechanism that rotates the blocking cam so that the at least one perpendicular surface secures the at least one cylindrical locking pin within the at least one cutout;

inserting the shackle into the lock body; and actuating the actuating mechanism to secure the at least one cylindrical locking pin within the at least one cutout.

9. The method of claim 8, wherein the at least one cutout comprises a first cutout and a second cutout, wherein the first cutout is compatibly-shaped to accept at least a portion of the first cylindrical locking pin and the second cutout is compatibly-shaped to accept at least a portion of the second cylindrical locking pin.

10. The method of claim 9, wherein the at least one perpendicular surface comprises a first perpendicular surface and a second perpendicular surface, wherein the first perpendicular surface secures the first cylindrical locking pin with the first cutout and the second perpendicular surface secures the second cylindrical locking pin with the second cutout.

11. The method of claim 8, wherein the actuating mechanism comprises a motor.

12. The method of claim 8, wherein the lock body defines at least one void in which the at least one cylindrical locking pin rests.

13. The method of claim 12, wherein the lock body further defines a void in which the blocking cam rotates, wherein the void and the at least one void are connected.

14. The method of claim 8, wherein the lock apparatus further comprises: a shackle retaining pin; a retaining sleeve; a motor; a plunger; and two springs.

15. A lock apparatus, comprising:

at least one cylindrical locking pin;

a shackle comprising at least one cutout that is compatibly-shaped to accept at least a portion of the at least one cylindrical locking pin;

a blocking cam comprising at least one sloped surface and at least one perpendicular surface; and a motor that rotates the blocking cam so that the at least one perpendicular surface secures the at least one cylindrical locking pin within the at least one cutout.

16. The lock apparatus of claim 15, wherein the motor is engaged by a plunger, a wireless signal, a button, or a key.

17. The lock apparatus of claim 15, wherein the blocking cam further comprises a motor interface, a stop feature, and a shaft.

18. A lock apparatus, comprising:

at least one cylindrical locking pin;

a shackle comprising at least one cutout that is compatibly-shaped to accept at least a portion of the at least one cylindrical locking pin;

a blocking cam comprising at least one sloped surface and at least one perpendicular surface;

an actuating mechanism that rotates the blocking cam so that the at least one perpendicular surface secures the at least one cylindrical locking pin within the at least one cutout;

a shackle retaining pin;

a retaining sleeve;

a motor;

a lock body;

a plunger; and two springs.

19. A method of securing a package with a lock apparatus, comprising the steps of:

inserting a package into a container comprising a closure consisting of a hasp and a loop;

closing the hasp over the loop;

inserting, through the loop, a shackle of the lock apparatus through the loop, wherein the shackle comprises at least one cutout that is compatibly-shaped to accept at least a portion of at least one cylindrical locking pin and wherein the lock apparatus further comprises:

a lock body;

the at least one cylindrical locking pin;

a blocking cam comprising at least one sloped surface and at least one perpendicular surface; and a motor that rotates the blocking cam so that the at least one perpendicular surface secures the at least one cylindrical locking pin within the at least one cutout;

inserting the shackle into the lock body; and actuating the motor to secure the at least one cylindrical locking pin within the at least one cutout.

20. The method of claim 19, wherein the motor is engaged by a plunger, a wireless signal, a button, or a key, wherein the step of actuating the motor further comprises pressing the plunger, sending the wireless signal, pressing the button, or turning the key.

21. The method of claim 19, wherein the blocking cam further comprises a motor interface, a stop feature, and a shaft.

22. A method of securing a package with a lock apparatus, comprising the steps of:

inserting a package into a container comprising a closure consisting of a hasp and a loop;

closing the hasp over the loop;

inserting, through the loop, a shackle of the lock apparatus through the loop, wherein the shackle comprises at least one cutout that is compatibly-shaped to accept at least a portion of at least one cylindrical locking pin and wherein the lock apparatus further comprises:

a lock body;

the at least one cylindrical locking pin;

a blocking cam comprising at least one sloped surface and at least one perpendicular surface;

an actuating mechanism that rotates the blocking cam so that the at least one perpendicular surface secures the at least one cylindrical locking pin within the at least one cutout;

a shackle retaining pin;

a retaining sleeve;

a motor;

a plunger; and two springs;

inserting the shackle into the lock body; and actuating the actuating mechanism to secure the at least one cylindrical locking pin within the at least one cutout.

* * * * *